United States Patent [19]

Lindgren

[11] 4,433,280

[45] Feb. 21, 1984

[54] INTERNAL COMBUSTION ENGINE IGNITION SYSTEM

[75] Inventor: Timothy F. Lindgren, Kokomo, Ind.

[73] Assignee: General Motors Corporation, Detroit, Mich.

[21] Appl. No.: 330,666

[22] Filed: Dec. 14, 1981

Related U.S. Application Data

[62] Division of Ser. No. 101,762, Dec. 10, 1979, Pat. No. 4,317,437.

[51] Int. Cl.[3] ..... F02P 5/08; F02P 1/00

[52] U.S. Cl. ..... 322/89; 123/418; 123/428

[58] Field of Search ..... 322/89, 99, 100, 29–32; 310/70 A, 156; 315/209 M, 209 T; 307/10 R; 123/414, 416, 418, 149 C

[56] References Cited

U.S. PATENT DOCUMENTS

| | | | |
|---|---|---|---|
| 3,752,139 | 8/1973 | Asplund . | |
| 3,910,243 | 10/1975 | Gau et al. . | |
| 4,099,495 | 7/1978 | Kiencke et al. . | |
| 4,126,112 | 11/1978 | Tershak | 123/428 X |
| 4,131,098 | 12/1978 | Daniels et al. | 315/209 T X |
| 4,142,489 | 3/1979 | Menard . | |
| 4,188,929 | 2/1980 | Podrapsky et al. | 123/149 C |
| 4,195,603 | 4/1980 | Decker et al. | 123/428 X |
| 4,239,024 | 12/1980 | Leichle | 123/416 |
| 4,245,591 | 1/1981 | Nishida et al. | 123/416 |
| 4,245,601 | 1/1981 | Crowder | 123/418 |

*Primary Examiner*—R. J. Hickey
*Attorney, Agent, or Firm*—C. R. Meland

[57] ABSTRACT

An internal combustion engine ignition system comprising the combination of an electronic data processor unit that is adapted to calculate an ignition spark event engine crankshaft angle, an associated electronic control unit, and a source of alternating current timing signals. The electronic control unit is responsive to the alternating current timing signals to produce an engine crankshaft position reference signal that is supplied as an input engine crankshaft position reference signal to the data processor unit and also is capable of effecting ignition spark in response to the alternating current timing signals during periods of engine crank and during periods of data processor unit malfunction.

1 Claim, 5 Drawing Figures

INTERNAL COMBUSTION ENGINE IGNITION SYSTEM

Figure 1:
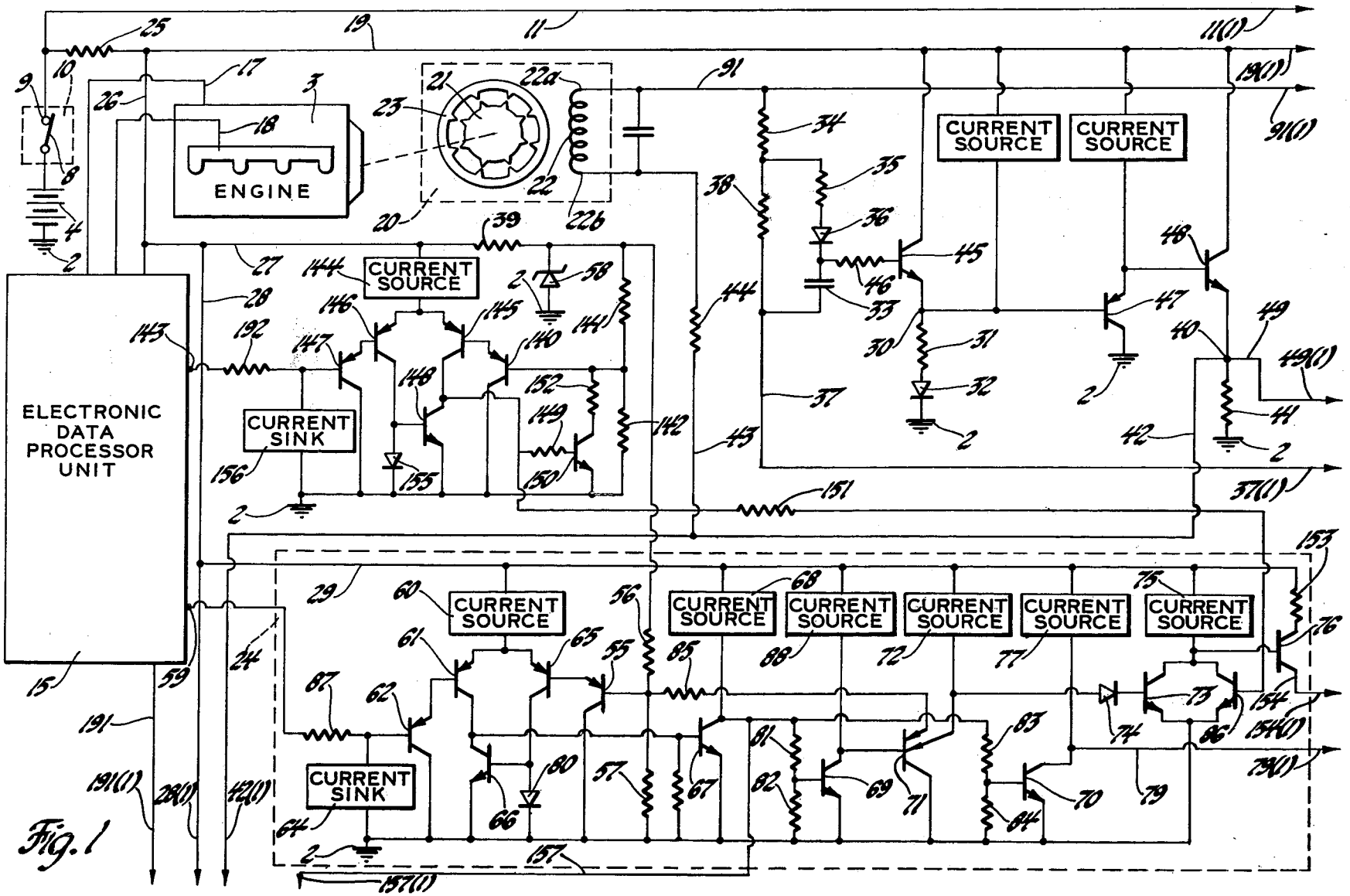

This is a division of application Ser. No. 101,762, filed Dec. 10, 1979, now U.S. Pat. No. 4,317,437.

This invention is directed to an internal combustion engine ignition system and, more specifically, to an internal combustion engine ignition system combination comprising an electronic data processor unit adapted to calculate an ignition spark event engine crankshaft angle, a source of alternating current timing signals, and an electronic control unit capable of effecting an ignition spark advance in response to the alternating current timing signal during periods of engine crank and of data processor unit malfunction.

The use of electronic data processor units adapted to calculate an ignition spark event engine crankshaft angle as determined by selected engine operating and ambient parameters is becoming increasingly widespread. With ignition systems of this type that operate asynchronously with the engine, it is necessary that the data processor unit be supplied with an engine crankshaft position reference signals, at least for one selected engine cylinder, and preferably, for all engine cylinders. Therefore, the provision of an internal combustion engine ignition system combination employing a data processor unit adapted to calculate an ignition spark event engine crankshaft angle for each cylinder of an associated internal combustion engine and including circuitry for producing an engine crankshaft position reference signal corresponding to each engine cylinder is desirable.

It is, therefore, an object of this invention to provide an improved internal combustion engine electronic ignition system.

It is another object of this invention to provide an improved internal combustion engine electronic ignition system including an electronic data processor unit adapted to calculate an ignition spark event engine crankshaft angle for each cylinder of an associated internal combustion engine and circuitry responsive to a series of alternating current timing signals produced in timed relationship with the associated engine to produce an engine crankshaft position reference signal corresponding to each engine cylinder that is provided as an input signal to the data processor unit.

It is another object of this invention to provide an improved internal combustion engine electronic ignition system that includes an electronic data processor unit adapted to calculate an ignition spark event engine crankshaft angle for each cylinder of an associated internal combustion engine, circuitry responsive to a series of alternating current timing signals produced in timed relationship with the associated engine for producing an engine crankshaft position reference signal corresponding to each engine cylinder that is supplied as an input signal to the data processor unit and switching circuitry adapted to effect an ignition spark event at the engine crankshaft angle as calculated by the data processor unit while the data processor unit is functional and to transfer the ignition spark event producing function to an electronic control unit responsive to the series of electrical timing signals during periods of engine crank or data processor unit malfunction.

It is a further object of this invention to provide an improved internal combustion engine electronic ignition system including circuitry responsive to a series of alternating current timing signals that are induced in the output coil of an electrical generator assembly in timed relationship with an associated internal combustion engine for producing an output signal of a selected polarity at the crossover point of the potential level with respect to a point of reference or ground potential upon a selected terminal end of the electrical generator assembly output coil and the potential level with respect to a point of reference or ground potential upon the other terminal end of the output coil.

In accordance with this invention, an internal combustion engine ignition system for controlling the ignition spark event of each cylinder of an associated internal combustion engine is provided, wherein an ignition spark event is effective for each engine cylinder at the engine crankshaft angle calculated by an electronic data processor unit with reference to an engine crankshaft position reference signal produced in response to a series of alternating current timing signals synchronized with the engine and wherein circuitry responsive to the alternating current timing signals is provided to effect an ignition spark event for each engine cylinder in response to each cycle of the alternating current timing signals during engine crank and while the data processor unit is not operational.

Figure 2:
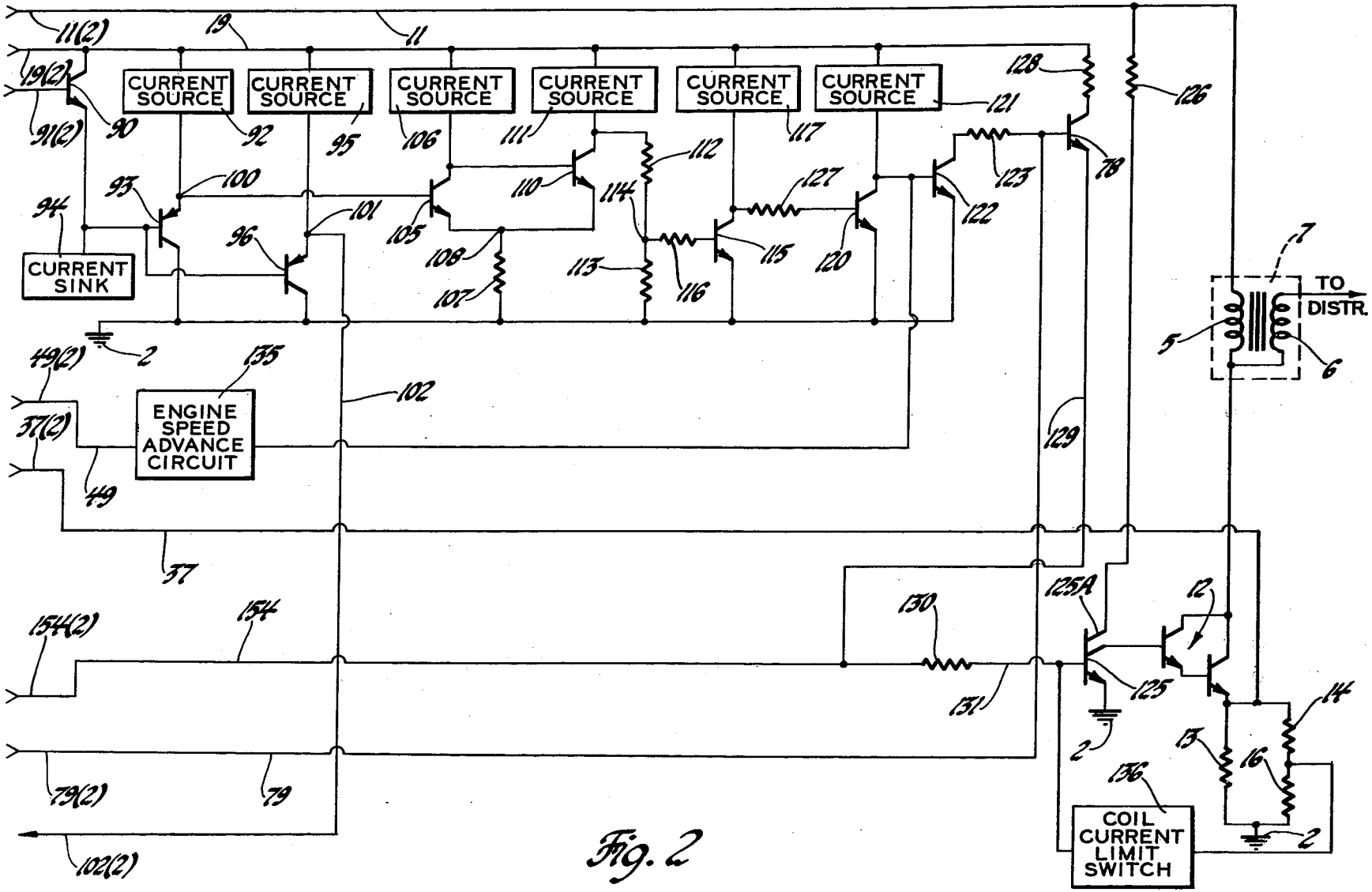
Figure 3:
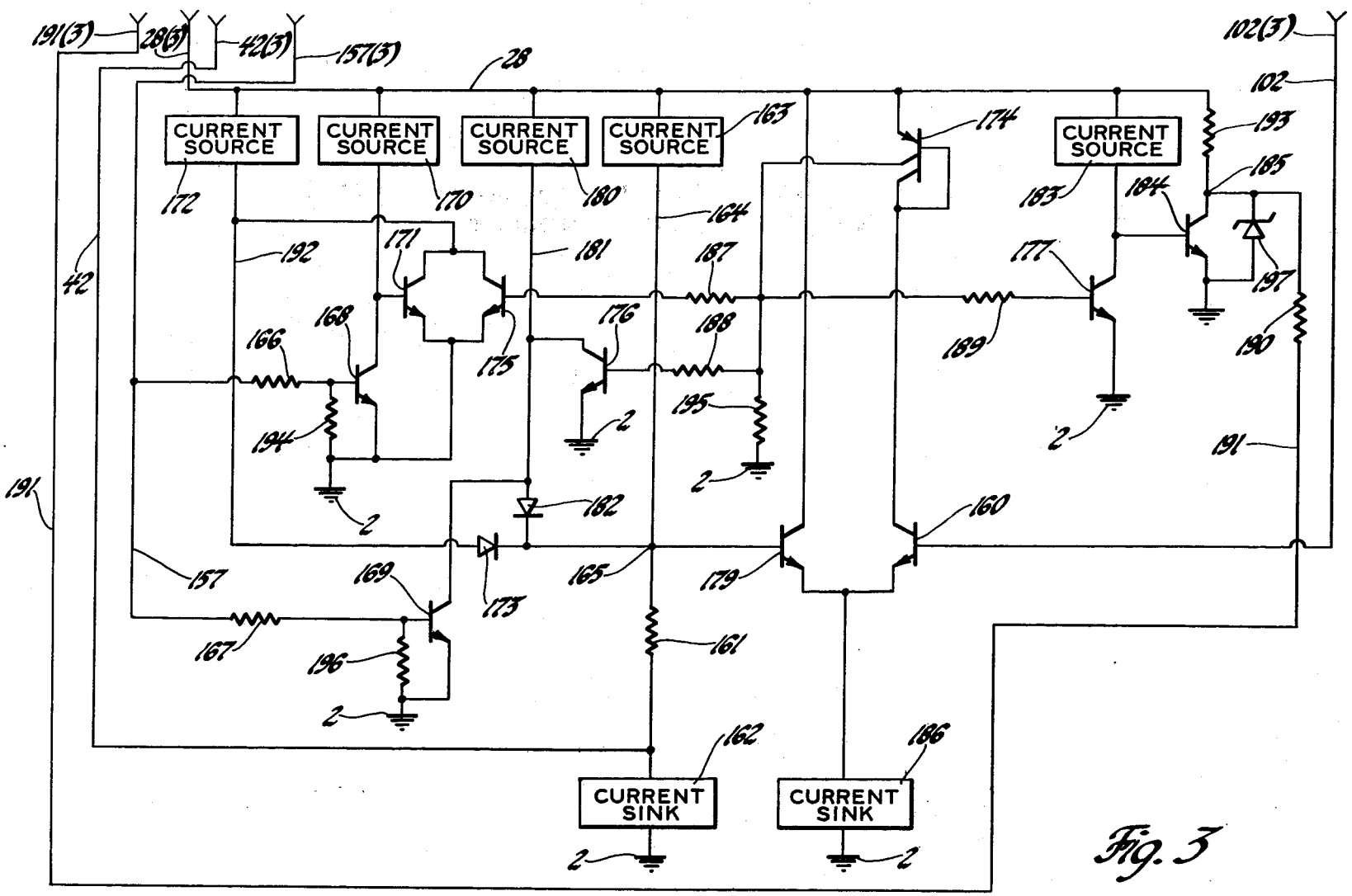
Figure 4:
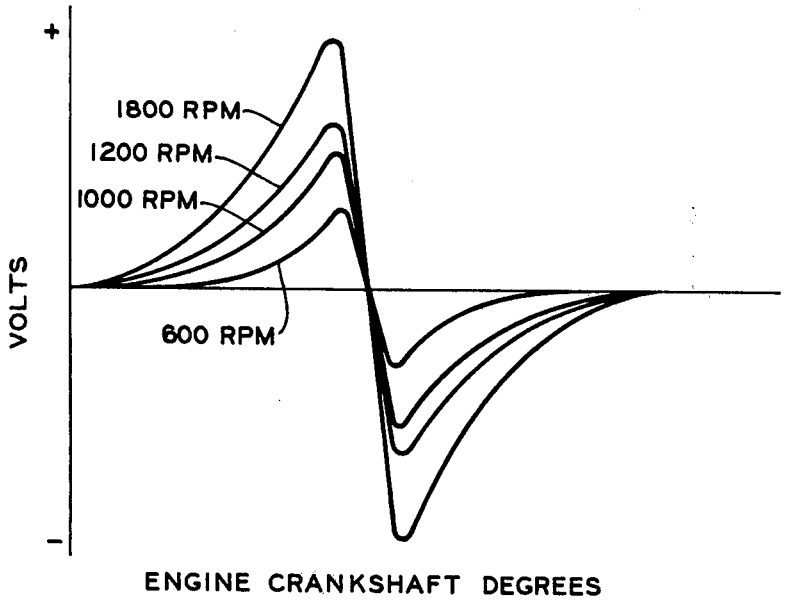
Figure 5:
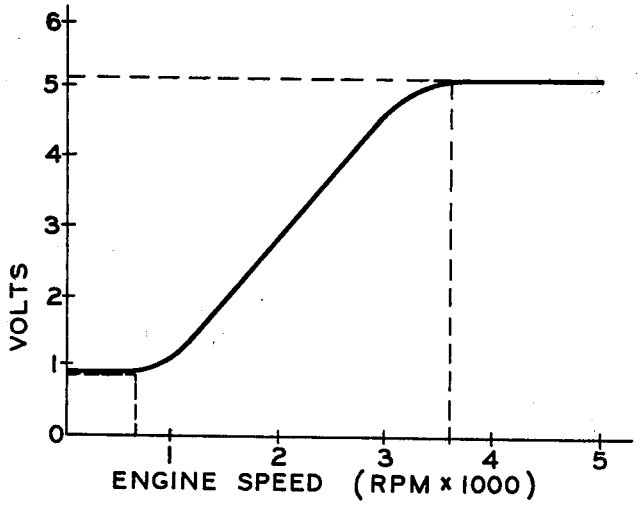

For a better understanding of the present invention, together with additonal objects, advantages, and features thereof, reference is made to the following description and accompanying drawing in which:

FIG. 1 sets forth the portion of the internal combustion engine ignition system of this invention including circuitry for providing a series of alternating current timing signals, an electronic data processor unit illustrated in block form and operating mode select switching circuitry;

FIG. 2 sets forth an electronic control unit capable of responding to the series of alternating current timing signals produced by the circuitry of FIG. 1 to effect an ignition spark event for each cylinder of an associated internal combustion engine;

FIG. 3 sets forth circuitry responsive to the alternating current timing signals produced by the circuitry of FIG. 1 for producing an output engine crankshaft position reference signal upon a selected polarity transistion of each cycle of the alternating current timing signals; and FIGS. 4 and 5 are respective curves useful in understanding the operation of the circuitry of FIGS. 1, 2 and 3.

As point of reference or ground potential is the same point electrically throughout the system, it is illustrated in the drawing by the accepted schematic symbol and is referenced by the numeral 2.

The circuit combination of FIGS. 1, 2 and 3 employs a plurality of current sources and current sinks. As these current sources and current sinks may be conventional circuitry well known in the art that, per se, forms no part of this invention, the current source and current sink circuitry is illustrated in block form.

In accordance with logic terminology well known in the art, throughout this specification logic signals will be referred to as "High" or logic 1 and "Low" or logic 0 signals. For purposes of this specification, and without intention or inference of a limitation thereto, the "High" or logic 1 signals will be considered to be of a positive polarity potential and the "Low" or logic 0 signals will be considered to be of zero or ground potential.

The internal combustion engine ignition system for controlling the ignition spark event of each cylinder of an associated internal combustion engine is set forth schematically in FIGS. 1, 2 and 3 and includes: (1) an electronic data processor unit adapted to calculate the ignition spark event engine crankshaft angle for each cylinder of the associated internal combustion engine, (2) circuitry for producing a series of alternating current timing signals in timed relationship with an associated engine, (3) circuitry responsive to the alternating current timing signals for producing an engine crankshaft position reference signal for each cylinder of the associated engine, (4) an electronic control unit capable of being responsive to the alternating current timing signals for effecting an ignition spark event for each cylinder of the engine, and (5) operating mode select switching circuitry adapted to select either the electronic data processor unit or the electronic control unit for effecting an ignition spark event for each cylinder of an associated engine.

Referring to the drawing, the internal combustion engine ignition system of this invention is set forth in combination with an internal combustion engine 3, FIG. 1, a source of operating potential that may be a conventional automotive type storage battery 4, and a conventional ignition coil 7, FIG. 2, having a primary winding 5 and a secondary winding 6 in which a high ignition spark potential is induced upon the interruption of the energizing circuit of primary winding 5. The energizing circuit for primary winding 5 of ignition coil 7 may be traced from the positive polarity output terminal of battery 4, FIG. 1, through movable contact 8 and stationary contact 9 of electrical switch 10, while closed, positive polarity potential lead 11, circuit points 11(1) and 11(2) of respective FIGS. 1 and 2, the FIG. 2 extension of lead 11, primary winding 5 of ignition coil 7, the current-carrying electrodes of NPN transistor switching Darlington pair 12, the parallel combination of resistor 13 and series resistors 14 and 16 and point of reference or ground potential 2 to the negative polarity output terminal of battery 4. With regard to electrical switch 10, movable contact 8 and stationary contact 9 may be the normally open "ignition circuit" contacts on a conventional automotive type ignition switch. As is well known in the automotive art, upon each interruption of the energizing circuit of primary winding 5 of ignition coil 7, a high ignition spark potential is induced in secondary winding 6 that is directed by the ignition distributor (not shown) to the spark plug of the cylinder of the associated engine to be fired. As ignition distributors and the function thereof are well known in the art and, per se, form no part of this invention, in the interest of reducing drawing complexity, the ignition distributor is not illustrated in the drawing. It is to be specifically understood, however, that the free terminal end of secondary winding 6 of ignition coil 7 is connected to the rotary contact of the associated automotive type ignition distributor.

As the electronic data processor unit may be any one of the many that are commercially available and, per se, forms no part of this invention, it is illustrated in FIG. 1 of the drawing in block form and is referenced by the numeral 15. One example of a commercially available electronic data processor unit suitable for use with this invention is marketed by Motorola Semiconductor Products, Inc. of Phoenix, Ariz. under the designation MC-6800. The electronic data processor unit employed with the internal combustion engine ignition system of this invention is adapted (1) to calculate an ignition spark event engine crankshaft angle for each cylinder of the associated engine, (2) to produce, subsequent to the occurrence of an input engine crankshaft position reference signal corresponding to each engine cylinder an output ignition dwell signal of a calculated duration for each engine cylinder that terminates at the calculated ignition spark event engine crankshaft angle for the cylinder to which it corresponds, and (3) to produce an operating mode select output signal of a first potential level while the associated engine is being cranked and while the data processor unit is inoperative due to a malfunction and of a second potential level while the data processor unit is operative. Examples of engine operating parameters upon which spark timing may be based are engine temperature and manifold vacuum electrical signals indicative of the values of these parameters may be applied to the electronic data processor unit 15 through respective leads 17 and 18. Any person skilled in the computer art is capable of adapting a commercially available data processor unit to perform these functions.

To produce a series of alternating current timing signals in timed relationship with an associated engine that are so phased relative to engine crankshaft angle that a selected polarity transition of each cycle thereof occurs at a preselected constant engine crankshaft angle relative to piston top dead center, there may be employed an electrical generator assembly 20 of the type having at least a rotatable rotor member 21 and an output coil 22 in which a series of alternating current timing signals is magnetically induced in timed relationship with the associated engine while the rotor member 21 is rotated in timed relationship with the engine. Rotor member 21 of electrical generator assembly 20 is driven by the associated internal combustion engine 3 in timed relationship with the engine 3 in a manner well known in the automotive art. For example, rotor member 21 may be mounted upon the ignition distributor shaft in such a manner as to be rotated therewith while the distributor shaft is rotated in timed relationship with engine 3 by a gear drive to the engine camshaft as is common in the automotive art. One complete cycle of the alternating current timing signals produced by an actual electrical generator assembly for each of four different engine speeds is illustrated by the curve of FIG. 4. Although each cycle of these timing signals has a positive to negative going polarity transition at substantially the same engine crankshaft angle at all engine speeds, the amplitude of these timing signals is directly proportional to engine speed, the greater the engine speed the greater the amplitude.

The source of alternating current timing signals, electrical generator assembly 20, may be any one of the several conventional magnetic distributors well known in the automotive art. One example of a magnetic distributor well known in the automotive art suitable for use with the ignition system of this invention is of the variable reluctance type disclosed and described in U.S. Pat. No. 3,254,247, Falge, that issued May 31, 1966 and is assigned to the same assignee as that of the present invention. In the interest of reducing drawing complexity, the variable reluctance type ignition distributor disclosed and described in U.S. Pat. No. 3,254,247 has been set forth schematically in FIG. 1. Rotor member 21 is rotated in timed relationship with engine 3 by the engine 3 in a manner well known in the automotive art within the bore of a pole piece 23. Equally spaced about the outer periphery of rotor member 21 and about the bore of pole piece 23 are a series of projections equal in number to the number of cylinders of the engine with which the distributor and system of this invention is being used. The electrical generator assembly 20 illustrated in FIG. 1 is for use with an 8-cylinder engine. In this regard, only the right side cylinder bank of a V-8 engine is illustrated in FIG. 1. Pole piece 23 may be made up of a stack of a number of laminations of magnetic material secured in stacked relationship by rivets or bolts or any other convenient fastening method and the magnetic flux may be provided by a permanent magnet, not shown, that may be secured to the lower face surface thereof. As each projection on rotor member 21 approaches a projection on pole piece 23, the reluctance of the magnetic path between rotor member 21 and pole piece 23 decreases and as each projection on rotor member 21 moves away from a projection on pole piece 23, the reluctance of the magnetic circuit between rotor member 21 and pole piece 23 increases. Consequently, the magnetic field produced by the permanent magnet increases and decreases as each projection on rotor member 21 approaches and passes a projection on pole piece 23, a condition that induces an alternating current potential in output coil 22, magnetically coupled to pole piece 23, of a waveform substantially as shown in FIG. 4.

In a manner to be explained in detail later in this specification, the circuitry of FIG. 3 is responsive to the alternating current timing signals induced in output coil 22 of electrical generator assembly 20 for producing an engine crankshaft position reference signal for each cylinder of engine 3 at a preselected constant engine crankshaft angle relative to piston top dead center that is supplied as an input signal to data processor unit 15; the circuitry of FIG. 2 is an electronic control unit including engine speed ignition spark advance circuitry that is capable of being responsive to the alternating current timing signals for effecting an ignition spark event for each cylinder of engine 3 at the ignition spark event engine crankshaft angle as determined by engine speed and the operating mode select switching circuitry contained within dashed line rectangle 24 of FIG. 1 is responsive to the data processor unit 15 operating mode select output signal of the first potential level for effecting an ignition spark event for each cylinder of engine 3 through the operation of the electronic control unit of FIG. 2 in response to the alternating current timing signals induced in output coil 22 of electrical generator assembly 20 and to the data processor unit 15 operating mode select output signal of the second potential level for effecting an ignition spark event for each cylinder of engine 3 in response to the termination of each of the data processor unit 15 output ignition dwell signals.

Upon the closure of movable contact 8 of electrical switch 10 into electrical circuit closing engagement with stationary contact 9, as shown in the drawing, battery 4 operating potential is supplied through current limiting resistor 25 to the circuitry of FIG. 1 through positive polarity potential leads 19, 26, 27, 28 and 29, to the circuitry of FIG. 2 through circuit points 19(1) and 19(2) of respective FIGS. 1 and 2 and the FIG. 2 extension of positive polarity potential lead 19 and to the circuitry of FIG. 3 through positive polarity potential leads 19, 26 and 28, circuit points 28(1) and 28(3) of respective FIGS. 1 and 3 and the FIG. 3 extension of positive polarity potential lead 28.

While the associated internal combustion engine 3 is not running with switch 10 closed, there is present upon junction 30 of FIG. 1 a direct current potential signal of a positive polarity with respect to point of reference or ground potential 2 and of magnitude equal to the sum of the potential drops across resistor 31 and diode 32. In the actual embodiment of the circuit of this invention, this potential signal is of the order of 0.9 of a volt while engine 3 is not running. While engine 3 is in the Run mode, capacitor 33 is charged by the halfwave rectified alternating current timing signals induced in output coil 22 of electrical generator assembly 20. During each positive polarity half cycle of the alternating current timing signals induced in output coil 22 while the terminal end *22a* thereof is of a positive polarity with respect to terminal end *22b*, capacitor 33 charges through a circuit that may be traced from terminal end *22a* of output coil 22, through resistors 34 and 35, diode 36, capacitor 33, and 37, circuit points 37(1) and 37(2) of respective FIGS. 1 and 2, the FIG. 2 extension of lead 37, the parallel combination of resistor 13 and series resistors 14 and 16, point of reference or ground potential 2, resistor 41 of FIG. 1, junction 40, leads 42 and 43 and resistor 44 to terminal end *22b* of output coil 22. The charge upon capacitor 33 supplies base-emitter drive current through resistor 46 to NPN transistor 45 to render this device conductive through the collector-emitter electrodes. While NPN transistor 45 is conductive, the additional current supplied thereby through resistor 31 and diode 32 results in an increased potential drop across resistor 31 that is of a positive polarity upon junction 30 with respect to point of reference or ground potential 2. As has been previously brought out in this specification, as the speed of the associated internal combustion engine increases, the amplitude of the alternating current timing signals induced in output coil 22 of electrical generator assembly 20 increases. Consequently, as the speed of the associated internal combustion engine increases, the charge upon capacitor 33 increases to supply an increasing base-emitter drive current to NPN transistor 45. As a result of this increased base-emitter drive current, the collector-emitter conduction of NPN transistor 45 increases to supply more current through resistor 31 and diode 32. This increased current flow through resistor 31 produces an increased potential drop thereacross of a positive polarity potential upon junction 30 with respect to point of reference or ground potential 2. Therefore, the potential level magnitude of the signal upon junction 30 with respect to point of reference or ground potential 2 increases with engine speed, as shown in FIG. 5, wherein the potential level magnitude in volts upon junction 30 with respect to point of reference or ground potential 2 is plotted against engine speed in RPM. In the actual embodiment as shown by the curve of FIG. 5, the potential level magnitude of the signal upon junction 30 with respect to point of reference or ground potential 2 is substantially constant during engine speeds up to a first value, increases substantially linearly in value to a substantially constant maximum value with an increase of engine speed between the first value and a second value and remains at the substantially constant maximum value with engine speeds greater than the second value. This is because of the saturation of NPN transistor 45 and the magnetic circuit of electrical generator assembly 20 at these higher engine speeds. In the actual embodiment, the substantially constant minimum low potential level magnitude upon junction 30 with respect to point of reference or ground potential 2 is of the order of 0.9 of a volt with engine speeds up to the order of 750 RPM, increases substantially linearly in value to a maximum potential level magnitude of the order of 5.2 volts between engine speeds of the order of 750 RPM and 3750 RPM and remains substantially constant at the maximum potential level magnitude of 5.2 volts with engine speeds greater than 3750 RPM. The combination of PNP transistor 47 and NPN transistor 48 comprises a unity gain amplifier circuit that prevents undesirable loading of the electrical generator assembly 20 output coil 22. As the potential level of the signal upon junction 30 is increased by one diode rise across PNP transistor 47 and is reduced by one diode drop across NPN transistor 48, the potential level of the signal upon junction 40 is substantially equal to and follows that upon junction 30, both with respect to point of reference or ground potential 2. As terminal end **22*b* of output coil 22 of electrical generator assembly 20 is connected to junction 40 through leads 42 and 43 and resistor 44, the potential level with respect to point of reference or ground potential upon terminal end 22*b* of output coil 22 is equal to and follows that upon junction 40. The circuitry described in this paragraph, therefore, functions to place a potential bias upon terminal end 22*b* of output coil 22 that increases from a selected minimum value to a maximum value as the speed of the engine increases from zero. As a consequence, this circuitry is effective to vary the potential level with respect to point of reference or ground potential 2 upon the selected terminal end 22*b* of output coil 22 of electrical generator assembly 20 in such a manner that this potential level increases from a selected minimum value to a maximum value as the speed of the engine 3 increases from zero. The potential signal upon junction 40 and, consequently, upon terminal end 22*b* of output coil 22 is employed as an input signal to the circuitry of FIG. 2 through lead 49, circuit points 49(1) of FIG. 1 and 49(2) of FIG. 2 and the FIG. 2 extension of lead 49 and to the circuitry of FIG. 3 through lead 42, circuit points 42(1) of FIG. 1 and 42(3) of FIG. 3 and the FIG. 3 extension of lead 42**.

As has been brought out previously in this specification, the operating mode select switching circuitry contained within dashed line rectangle 24 is responsive to the data processor unit 15 operating mode select output signal of the first potential level for effecting an ignition spark event for each cylinder of engine 3 through the operation of the electronic control unit of FIG. 2 in response to the alternating current timing signals and to the data processor unit 15 operating mode select output signal of the second potential level for effecting an ignition spark event for each cylinder of engine 3 in response to the termination of each data processor unit 15 output ignition dwell signal. A threshold potential is established upon the base electrode of PNP transistor 55 by a resistor divider consisting of series resistors 56 and 57 connected across Zener diode 58 and point of reference or ground potential 2. With a logic 0 operating mode select output signal upon output terminal 59 of data processor unit 15, a potential level that is less than that of the threshold potential level applied to the base electrode of transistor 55, the base drive current for NPN transistor 62 is provided by current sink 64 to thereby render NPN transistor 62 conductive. The emitter current of conducting NPN transistor 62 thus provides base drive current for NPN transistor 61 to render this device conductive with emitter current for NPN transistor 61 being provided by current source 60. With PNP transistors 61 and 62 conductive, PNP transistors 65 and 55 are not conductive and NPN transistor 66 is not conductive as there is no base-emitter drive current supplied thereto. With NPN transistor 66 not conducting, the emitter-collector current of PNP transistor 61 supplies base-emitter drive current to NPN transistor 67 to render this device conductive through the collector-emitter electrodes. With NPN transistor 67 conductive, the current supplied by current source 68 is diverted to point of reference or ground potential 2. While the current supplied by current source 68 is diverted to point of reference or ground potential 2 through conducting NPN transistor 67, there is no drive current available for NPN transistors 69 and 70, consequently, these devices are not conductive. With transistor 69 not conductive, current source 88 pulls the base electrode of PNP transistor 71 high enough to render this device not conductive. With PNP transistor 71 not conductive, current source 72 supplies base-emitter drive current through diode 74 to NPN transistor 73 to render NPN transistor 73 conductive through the collector-emitter electrodes. As conducting NPN transistor 73 diverts the current supplied by current source 75 to point of reference or ground potential 2, there is no base-emitter drive current supplied to NPN transistor 76, consequently, this device is not conductive. As NPN transistor 70 is also not conductive at this time, the current supplied by current source 77 is available as base-emitter drive current for NPN transistor 78 of FIG. 2 through lead 79, circuit points 79(1) and 79(2) of respective FIGS. 1 and 2 and the FIG. 2 extension of lead 79. With this base-emitter drive current available to the base electrode of NPN transistor 78 of FIG. 2, each ignition spark event is effected by the electronic control unit of FIG. 2 in response to the alternating current timing signals induced in output coil 22 of electrical generator assembly 20 in a manner to be later explained in detail. With a logic 1 operating mode select output signal upon output terminal 59 of electronic data processor unit 15, the potential level upon the base electrode of PNP transistor 62 is sufficiently high to prevent emitter-base drive current therethrough, consequently, PNP transistors 61 and 62 are both not conductive. With PNP transistors 61 and 62 not conductive, current source 60 supplies emitter-base drive current to both PNP transistors 65 and 55 to render these devices conductive through the emitter-collector electrodes thereof. With PNP transistor 65 conductive, base-emitter drive current is supplied to NPN transistor 66 to condition this device for collector-emitter conduction and current flows through diode 80 to point of reference or ground potential 2. With base-emitter drive current being supplied to NPN transistor 66, the collector electrode thereof will be of a low potential, consequently, NPN transistor 67 is not conductive. With NPN transistor 67 not conductive, current source 68 supplies base-emitter drive current to NPN transistors 69 and 70, each of which has the base electrode thereof connected to the junction between series resistors 81 and 82 and 83 and 84, respectively, to render these transistors conductive. With NPN transistor 69 conductive, base drive current is provided for PNP transistor 71 to render this device conductive through the emitter-collector electrodes thereof. With PNP transistor 71 conductive, current flows through resistor 85 and the current supplied by current source 72 is sinked to point of reference or ground potential 2. With current flowing through resistor 85, the threshold voltage upon the base electrode of PNP transistor 55 will be lowered to provide a lower turn-off threshold. Thus, hystersis is accomplished for this input switching. With the current supplied by current source 72 sinked to point of reference or ground potential 2 through conducting PNP transistor 71, there is no base-emitter drive current supplied to NPN transistor 73, consequently, this device is not conductive. With NPN transistor 73 not conductive, the current supplied by current source 75 is available to supply base-emitter drive current to NPN transistor 76, depending upon the state of conduction of NPN transistor 86. The function and operation of NPN transistor 86 will be later explained in this specification. With NPN transistor 70 conductive, to sink the current supplied by current source 77 to point of reference or ground potential 2, the current supplied by current source 77 is not available as a drive current for NPN transistor 78 of FIG. 2, consequently, the electronic control unit of FIG. 2 is locked out. An additional feature of this switching circuitry is, should the circuit between output terminal 59 of electronic data processor unit 15 and the base electrode of PNP transistor 62 become opencircuited, the system will automatically go to the operating mode in which the ignition spark event is effected by the electronic control unit of FIG. 2 in response to the alternating current timing signals induced in output coil 22 of electrical generator assembly 20. This is because current sink 64 pulls the base electrode of PNP transistor 62 "low" to thus simulate a logic 0 input signal. Consequently, the logic 1 operating mode select output signal upon output terminal 59 of data processor unit 15 must be of a sufficient level to overcome the effect of this current sink in its transition from a logic 0 to a logic 1 state. Resistor 87 is a current limiting resistor inserted in this input circuitry.

While engine 3 is running, the alternating current timing signals are induced in output coil 22 of electrical generator assembly 20. As the potential level upon terminal end **22*a* of output coil 22 of electrical generator assembly 20 begins to increase in a positive going direction during the positive polarity half cycles of the alternating current timing signals induced in output coil 22, a potential level is reached at which base-emitter drive current is supplied to NPN transistor 90 of FIG. 2 through lead 91, circuit points 91(1) and 91(2) of respective FIGS. 1 and 2 and the FIG. 2 extension of lead 91 to render NPN transistor 90 conductive through the collector-emitter electrodes thereof. The combination of NPN transistor 90, current source 92, PNP transistor 93 and current sink 94 comprises a first unity gain amplifier circuit and the combination of NPN transistor 90, current source 95, PNP transistor 96 and current sink 94 comprises a second unity gain amplifier circuit. These unity gain amplifier circuits prevent undesirable loading of the electrical generator assembly 20 output coil 22. The potential level with respect to point of reference or ground potential 2 upon terminal end 22*a* of output coil 22 as each cycle of the alternating timing signals induced therein cycles through the positive and negative polarity excursions appears upon the base electrode of NPN transistor 90 of FIG. 2. As the potential level of this signal upon the base electrode of NPN transistor 90 is reduced by one diode drop across transistor 90 and is increased by one diode rise across each of NPN transistors 93 and 96, the potential level of the signal upon each of junctions 100 and 101 is substantially equal to and follows that upon terminal end 22*a* of output coil 22 while transistor 90 is conducting, all with respect to point of reference or ground potential 2. The potential level of the signal upon junctions 100 and 101, therefore, may be considered to be that of the signal upon terminal end 22*a* of output coil 22. The potential signal upon junction 101 is applied to the circuitry of FIG. 3 through lead 102, circuit points 102(2) and 102(3) of respective FIGS. 2 and 3 and the FIG. 3 extension of lead 102**.

With a logic 0 operating mode select output signal upon output terminal 59 of electronic data processor unit 15, the ignition spark event for each cylinder of engine 3 is effected through the operation of the electronic control unit of FIG. 2 in response to the alternating current timing signals induced in output coil 22 of electrical generator assembly 20 in a manner now to be explained.

When the potential signal with respect to point of reference or ground potential 2 upon terminal end **22*a* of output coil 22 and, hence, upon junction 100 of FIG. 2, during each positive polarity half cycle of the alternating current timing signal induced in output coil 22 increases to a potential level sufficient to provide base-emitter drive current to NPN transistor 105 of FIG. 2, this device is rendered conductive through the collector-emitter electrodes thereof. Conducting transistor 105 sinks the current supplied by current source 106 to point of reference or ground potential 2 through common emitter resistor 107. With current flowing through resistor 107, the potential drop thereacross appearing upon junction 108 is of a sufficient magnitude to maintain NPN transistor 110 not conductive. With NPN transistor 110 not conductive, the current supplied by current source 111 flows through series resistors 112 and 113. The potential level upon junction 114, as a result of this current flow, is sufficient to supply base-emitter drive current through resistor 116 to NPN transistor 115 to render transistor 115 conductive through the collector-emitter electrodes. With transistor 115 conductive, the current supplied by current source 117 is sinked to point of reference or ground potential 2 through the current carrying elements thereof. As a consequence, there is no base-emitter drive current supplied to NPN transistor 120 to maintain this device not conductive. While transistor 120 is not conductive, current source 121 supplies base-emitter drive current to NPN transistor 122 to render this device conductive through the collector-emitter electrodes. While NPN transistor 122 is conductive, the current supplied by current source 77 of FIG. 1 is sinked to point of reference or ground potential 2 through lead 79, circuit points 79(1) and 79(2) of respective FIGS. 1 and 2, the FIG. 2 extension of lead 79, resistor 123 and the collector-emitter electrodes of conducting transistor 122. As this current is sinked to point of reference or ground potential 2, there is no base-emitter drive current supplied to NPN transistor 78, consequently, this device is not conductive. While transistor 78 is not conductive, and while transistor 76 of FIG. 1 is not conductive, as previously brought out in the explanation of the operation of the operating mode select switching circuitry of FIG. 1 contained within dashed line rectangle 24, there is no base-emitter drive current supplied to control transistor 125, consequently, this device is not conductive. Control transistor 125 is a silicon planar transistor described in detail in U.S. Pat. No. 3,838,672, Richards et al, that issued Oct. 1, 1974 and is assigned to the same assignee as that of the present invention. Briefly, however, while this transistor 125 is not conducting through the collector-emitter electrodes, current flows through the quasi-collector electrode 125A and while this transistor is conducting through the collector-emitter electrodes, substantially no current flows through the quasi-collector electrode 125A. Consequently, while control transistor 125 is not conducting, base-emitter drive current is supplied to the NPN transistor switching Darlington pair 12 through a circuit that may be traced from the positive polarity output terminal of battery 4 of FIG. 1, through the closed contacts 8 and 9 of switch 10, lead 11, circuit points 11(1) and 11(2) of respective FIGS. 1 and 2, the FIG. 2 extension of lead 11, resistor 126 and through quasi-collector electrode 125A of control transistor 125 to NPN transistor switching Darlington pair 12. This drive current renders NPN transistor switching Darlington pair 12 conductive through the current carrying elements thereof to complete the previously described energizing circuit for primary winding 5 of ignition coil 7. When the negative going portion of each positive polarity half cycle of the alternating current timing signals upon terminal end 22***a* of output coil 22 of electrical generator assembly 20 passes through the potential level upon terminal end 22*b* of output coil 22, there is an insufficient positive polarity potential level upon junction 100 to supply base-emitter drive current to NPN transistor 105, consequently, this device goes not conductive. When transistor 105 goes not conductive, current source 106 supplies base-emitter drive current to NPN transistor 110 to render this device conductive through the collector-emitter electrodes thereof. Conducting transistor 110 sinks the current supplied by current source 111 to point of reference or ground potential 2 through the current carrying elements thereof and common emitter resistor 107. The potential appearing upon junction 108, as a result of this current flow through common emitter resistor 107, is of a sufficient value to maintain NPN transistor 105 not conductive. Upon the sinking of the current supplied by current source 111, the point of reference or ground potential 2, base-emitter drive current is no longer supplied to NPN transistor 115, consequently, this device goes not conductive. Upon transistor 115 going not conductive, current source 117 supplies base-emitter drive current through resistor 127 to NPN transistor 120 to render transistor 120 conductive. Upon the conduction of transistor 120, the current supplied by current source 121 is sinked to point of reference or ground potential 2 through the current-carrying elements of transistor 120 to remove base-emitter drive current from NPN transistor 122. Upon the removal of this drive current, NPN transistor 122 goes not conductive. While NPN transistor 122 is not conductive, current source 77 of FIG. 1 supplies base-emitter drive current through a circuit previously described to NPN transistor 78. This base-emitter drive current renders transistor 78 conductive through the collector-emitter electrodes. Upon the conduction of transistor 78, base-emitter drive current is supplied to control transistor 125 through a circuit that may be traced from the positive polarity output terminal of battery 4, through the closed contacts 8 and 9 of switch 10, resistor 25, lead 19, circuit points 19(1) and 19(2) of respective FIGS. 1 and 2, the FIG. 2 extension of lead 19, resistor 128, the current carrying electrodes of transistor 78, lead 129, resistor 130, lead 131, the base-emitter electrodes of control transistor 125 and point of reference or ground potential 2 to the negative polarity output terminal of battery 4. This drive current renders control transistor 125 conductive through the collector-emitter electrodes thereof, a condition that drains base drive current from the NPN transistor switching Darlington pair 12 to render these devices abruptly not conductive. When the NPN transistor switching Darlington pair 12 abruptly goes not conductive, the previously described energizing circuit for primary winding 5 of ignition coil 7 is abruptly interrupted to induce a high ignition spark potential in secondary winding 6 that is directed to the cylinder of engine 3 to be fired through the ignition distributor (not shown) in a manner well known in the automotive art. The electronic control unit of FIG. 2 includes an engine speed advance circuit illustrated in the drawing in block form and referenced by the numeral 135. The engine speed advance circuit 135 is disclosed and described in detail in U.S. patent application Ser. No. 036,355, Crowder, that was filed May 7, 1979 and is assigned to the same assignee as that of the present invention. Briefly, however, the engine speed advance circuit 135 is responsive to the signal appearing upon junction 40 of FIG. 1 to provide an ignition spark advance that increases along a predetermined ignition spark advance curve as the speed of engine 3 increases. The coil current limit circuitry indicated in block form in the drawing and referenced by the numeral 136 operates in response to a predetermined current flow through the NPN transistor switching Darlington pair 12 of a predetermined magnitude to maintain this current at the predetermined magnitude. This coil current limiting circuitry 136 is disclosed and described in detail in the aforementioned U.S. Pat. No. 3,838,672. From this discussion, it is apparent that the electronic control unit of FIG. 2 is responsive to the alternating current timing signals induced in output coil 22 of electrical generator assembly 20 for effecting an ignition spark event for each cylinder of engine 3 at the ignition spark event crankshaft angle as determined by engine speed. Further from this description, it is apparent that the operating mode select switching circuitry contained within dashed line rectangle 24 of FIG. 1 is responsive to a logic 0 operating mode select output signal from electronic data processor unit 15 to effect ignition coil primary winding energization and deenergization in response to the alternating current timing signals induced in output coil 22 of electrical generator assembly 20.

As has been previously brought out in this specification, with a logic 1 operating mode select output signal present upon output terminal 59 of data processor unit 15, transistor 70 of FIG. 1 is maintained conductive to lock out the electronic control unit of FIG. 2. With a logic 1 operating mode select output signal upon output terminal 59 of electronic data processor unit 15, therefore, the energization and deenergization of primary winding 5 of ignition coil 7 is effected by the electronic data processor unit 15 output ignition dwell signal of a calculated duration for each engine cylinder that terminates at the calculated ignition spark event crankshaft angle of the cylinder to which it corresponds in a manner now to be explained.

Referring to FIG. 1, a threshold potential is established at the base electrode of PNP transistor 140 that is connected to the junction between series resistors 141 and 142 that are connected across Zener diode 58 and point of reference or ground potential 2. When electronic data processor unit 15 produces an ignition dwell signal, a logic 1 signal appears upon output terminal 143 thereof. As the potential level of this signal is greater than that of the threshold potential applied to the base electrode of PNP transistor 140, current source 144 supplies emitter-base drive current to PNP transistors 145 and 140 to render these devices conductive through the emitter-collector electrodes thereof. With these transistors conducting, PNP transistors 146 and 147 and NPN transistor 148 are not conductive. As NPN transistor 148 is not conductive, the emitter-collector current of PNP transistor 145 supplies base-emitter drive current through resistor 149 to NPN transistor 150 and through resistor 151 to NPN transistor 86 of the operating mode select switching circuitry contained within dashed line rectangle 24 to render these devices conductive through the collector-emitter electrodes. Conducting transistor 150 connects resistor 152 in parallel with resistor 142 and, thereby, effectively sets a lower turn-off threshold potential level upon the base of PNP transistor 140 to provide hysteresis for the output terminal 143 switching. Conducting transistor 86 diverts the current supplied by current source 75 to point of reference or ground potential 2, consequently, transistor 76 is not conductive. While transistor 76 is not conductive, the circuit through which base-emitter drive current may be supplied to control transistor 125 from positive polarity potential lead 29 through resistor 153, the collector-emitter electrodes of transistor 76, lead 154, circuit points 154(1) and 154(2) of respective FIGS. 1 and 2, the FIG. 2 extension of lead 154, resistor 130 and lead 131 is interrupted. Consequently, control transistor 125 is not conductive. While control transistor 125 is not conductive, current flows out of quasi-collector electrode 125A thereof to supply base-emitter drive current NPN transistor switching Darlington pair 12 to render this device conductive through the current carrying elements thereof to establish the previously described energizing circuit for primary winding 5 of ignition coil 7. When the ignition dwell signal upon output terminal 143 of data processor unit 15 terminates at the calculated ignition spark event crankshaft angle of the cylinder to which it corresponds, the signal upon output terminal 143 goes to a logic 0. With a logic 0 signal present upon output terminal 143 of electronic data processor unit 15, a potential level that is less than that of the threshold potential level applied to the base electrode of PNP transistor 140, PNP transistors 146 and 147 are rendered conductive through the emitter-collector electrodes thereof. As these conducting transistors divert emitter-base drive current from PNP transistors 145 and 140, these devices are rendered not conductive. The emitter-collector current of transistor 146 provides a current flow through diode 155 and supplies base-emitter drive current for NPN transistor 148 to render this device conductive through the collector-emitter electrodes. As conducting NPN transistor 148 diverts the base-emitter drive current supplied to NPN transistor 150 and to NPN transistor 86 of the operating mode select switching circuitry contained within dashed line rectangle 24 to point of reference or ground potential 2, these devices are rendered not conductive. In a manner previously explained, with a logic 1 operating mode select output signal present upon output terminal 59 of electronic data processor unit 15, NPN transistor 73 of the operating mode select switching circuitry contained within dashed line rectangle 24 is not conductive. With transistors 73 and 86 not conducting, current source 75 supplies base-emitter drive current to NPN transistor 76 to render this device conductive through the collector-emitter electrodes thereof. Conducting NPN transistor 76 provides base-emitter drive current for control transistor 125 of FIG. 2 through a circuit that may be traced from positive polarity potential lead 29, through resistor 153, the collector-emitter electrodes of transistor 76, lead 154, circuit points 154(1) and 154(2) of respective FIGS. 1 and 2, the FIG. 2 extension of lead 154, resistor 130, lead 131, the base-emitter electrodes of control transistor 125 and point of reference or ground potential 2 to the negative polarity output terminal of battery 4. This drive current renders control transistor 125 conductive through the collector-emitter electrodes thereof, a condition that drains base drive current from NPN transistor switching Darlington pair 12 to render these devices abruptly not conductive. When the NPN transistor Darlington pair 12 goes abruptly not conductive, the previously described energizing circuit for primary winding 5 of ignition coil 7 is abruptly interrupted to induce a high ignition spark potential in secondary winding 6 that is directed to the cylinder of the engine to be fired through the ignition distributor (not shown) in a manner well known in the automotive art. Current sink 156 operates to pull the base electrode of PNP transistor 147 "low" in the event of an open circuit. From this description, it is apparent that the operating mode select switching circuitry contained within dashed line rectangle 24 of FIG. 1 is responsive to a logic 1 operating mode select output signal from electronic data processor unit 15 to lock out the electronic control unit of FIG. 2, to effect the completion of the ignition coil primary winding 5 energizing circuit upon the occurrence of each data processor unit 15 output dwell signals and to effect the interruption of the ignition coil primary winding 5 energizing circuit in response to the termination of each of the data processor unit 15 output ignition dwell output signals.

The circuitry of FIG. 3 is responsive to the alternating current timing signals induced in output coil 22 of electrical generator assembly 20 to produce an engine crankshaft position reference signal for each cylinder of engine 3 at a preselected constant engine crankshaft angle relative to piston top dead center that is supplied as an input signal to the electronic data processor unit 15 in a manner to be now explained. The potential level signal upon terminal end **22*a* of output coil 22 as the alternating current timing signals pass through the respective successive cycles that appears upon junction 101 of FIG. 2 in a manner previously explained is taken from junction 101 and applied to the base electrode of NPN transistor 160 of FIG. 3 through lead 102, circuit points 102(2) and 102(3) of respective FIGS. 2 and 3 and the FIG. 3 extension of lead 102. The potential level signal upon terminal end 22*b* of output coil 22 that appears upon junction 40 of FIG. 1 in a manner previously explained is taken from junction 40 and applied to the junction between resistor 161 and current sink 162 of FIG. 3 through lead 42, circuit points 42(1) and 42(3) of respective FIGS. 1 and 3 and the FIG. 3 extension of lead 42. The current produced by current source 163 flows through lead 164 and resistor 161 and is sinked to point of reference or ground potential 2 by current sink 162. As the potential level signal upon terminal end 22*b* of output coil 22 is applied to the junction between resistor 161 and current sink 162, the reference potential signal upon junction 165 with respect to point of reference or ground potential 2** is equal to the sum of the potential levels with respect to point of reference or ground potential 2 upon terminal end 22*b* of output coil 22 plus the potential drop across resistor 161 as a result of the current supplied by current source 163. Therefore, the potential level of the reference potential signal upon junction 165 with respect to point of reference or ground potential 2 is of a substantially constant incremental potential value that is equal to the potential drop across resistor 161 as a result of the current supplied by current source 163 flowing therethrough greater than the potential level upon terminal end 22*b* of the electrical generator assembly output coil 22 at all engine speeds. This circuitry, therefore, produces a reference potential signal of a first potential level that is of a first selected substantially constant incremental potential value greater than the potential level upon the selected terminal end 22*b* of the electrical generator assembly output coil 22 at all engine speeds.

As previously explained in this specification, with a logic 0 operating mode select output signal upon output terminal 59 of electronic data processor unit 15, NPN transistor 67 of the operating mode select switching circuitry contained within dashed line rectangle 24 of FIG. 1 is conductive through the collector-emitter electrodes thereof to sink the current supplied by current source 68 to point of reference or ground potential 2. As the current supplied by current source 68 is sinked to point of reference or ground potential 2 through conducting transistor 67, there is no base-emitter drive current supplied through lead 157, circuit points 157(1) and 157(3) of respective FIGS. 1 and 3, the FIG. 3 extension of lead 157 and thence through respective resistors 166 and 167 to NPN transistors 168 and 169, consequently, these devices are not conductive. With transistor 168 not conductive, current source 170 supplies base-emitter drive current to NPN transistor 171 to render this device conductive through the collector-emitter electrodes thereof. Conductive transistor 171 diverts the current produced by current source 172 to point of reference or ground potential 2. As a consequence, there is no flow of current through diode 173. The circuitry including current source 172 and diode 173, therefore, is deactivated by conducting transistor 171. Assuming that the potential signal upon terminal end 22*a* of output coil 22 of electrical generator assembly 20 is of a negative polarity with respect to the potential signal upon terminal end 22*b*, NPN transistor 160 is not conductive. With transistor 160 not conducting, there is no circuit through which emitter-base drive current may be supplied to dual collector PNP transistor 174, consequently, this device is also not conductive. While transistor 174 is not conductive, there is no base-emitter drive current supplied to NPN transistors 175, 176 and 177, consequently, these devices are also not conductive. With transistor 169 and transistor 176 not conductive, the current supplied by current source 180 flows through lead 181, diode 182 and resistor 161 and is sinked to point of reference or ground potential 2 through current sink 162. As a result of this current flow through resistor 161 in addition to the current supplied by current source 163 flowing through resistor 161, the reference potential signal upon junction 165 is increased to a second potential level with respect to point of reference or ground potential 2 that is of a second selected substantially constant incremental potential value greater than the first potential level of this reference signal by an amount equal to the potential drop across resistor 161 as a result of the additional current supplied by current source 180 flowing therethrough. This second selected substantially constant incremental potential value is added to the potential level appearing upon terminal end 22*b* of output coil 22 of the electrical generator assembly 20 at all engine speeds. As transistor 169, as previously explained, is not conductive during the presence of a logic 0 operating mode select output signal upon output terminal 59 of electronic data processor unit 15, the circuitry including current source 180 and diode 182 is activated in response to a logic 0 data processor unit 15 operating mode select output signal. Consequently, the circuitry including current source 180 and diode 182 is effective when activated in response to a logic 0 data processor unit operating mode select output signal to increase the reference potential signal upon junction 165 to a second potential level that is of a second selected substantially constant incremental potential value greater than that of the first potential level at all engine speeds. The reference potential signal of the second potential level upon junction 165 supplies base-emitter drive current to NPN transistor 179 to render this device conductive through the collector-emitter electrodes thereof and is the potential level with respect to point of reference or ground potential 2 to which the potential level with respect to point of reference or ground potential 2 upon terminal end 22*a* of output coil 22 of electrical generator assembly 20 must rise to render NPN transistor 160 conductive. The non-conduction of NPN transistor 175 is of no consequence at this time as NPN transistor 171 with which it is connected in parallel is conductive. With NPN transistor 177 not conducting, current source 183 supplies base-emitter drive current to NPN transistor 184 to render this device conductive through the collector-emitter electrodes thereof. With transistor 184 conducting, the potential upon junction 185, the output signal of the circuitry of FIG. 3, is substantially ground potential or a logic 0. As the potential level with respect to point of reference or ground potential 2 upon terminal end 22*a* of output coil 22 of electrical generator assembly 20 increases in a positive going direction to a potential level substantially equal to that of the reference potential signal of the second potential level present upon junction 165, transistor 160 is rendered conductive. When transistor 160 conducts, transistor 179 goes not conductive and transistor 174 emitter-collector current begins to flow through conducting transistor 160 and current sink 186 to point of reference or ground potential 2. The collector current of transistor 174 supplies base-emitter drive current through resistors 187, 188, and 189 to respective NPN transistors 175, 176 and 177 to render these devices conductive. As transistor 175 is connected in parallel with an already conducting transistor 171, this transistor is of no consequence at this time. Conducting transistor 176, however, diverts the current supplied by current source 180 to point of reference or ground potential 2 and conducting transistor 177 diverts the current supplied by current source 183 to point of reference or ground potential 2. As conducting transistor 177 diverts the current supplied by current source 183 to point of reference or ground potential 2, insufficient base-emitter drive current is supplied to NPN transistor 184 to maintain this device conductive, consequently, transistor 184 goes not conductive. When transistor 184 goes not conductive, the signal upon junction 185, the output signal of the circuitry of FIG. 3, is of a potential level substantially equal to the Zener diode 197 potential and is therefore a logic 1 output signal. As conducting transistor 176 diverts the current supplied by current source 180 to point of reference or ground potential 2, the current supplied by current source 180 no longer flows through resistor 161 and current sink 162. Consequently, when the potential level upon terminal end 22*a* of output coil 22 of electrical generator assembly 20 attains a level substantially equal to that of the reference potential signal of the second potential level upon junction 165, the circuitry including current source 180 and diode 182 that is effective to increase the reference potential signal upon junction 165 to the second potential level is deactivated and the reference potential signal upon junction 165 is reduced to the first potential level that is of a value substantially equal to the potential level upon terminal end 22*b* of output coil 22 of electrical generator assembly 20 plus the potential drop across resistor 161 as a result of the current supplied by current source 163 flowing therethrough. This lower reference potential signal of the first potential level upon junction 165 sets the turn-off point for transistor 160. As the potential level upon terminal end 22*a* of output coil 22 of electrical generator assembly 20 continues through the positive polarity half of each cycle of the alternating current timing signals induced therein, this potential level goes through maximum and falls in a negative going direction until it is of a level substantially equal to that of the reference potential signal of the first potential level present upon junction 165. At this time, NPN transistor 160 is rendered not conductive and NPN transistor 179 is rendered conductive. Upon transistor 160 going not conductive, emitter-collector current flow ceases through transistor 174 to place the circuitry in the initial state with NPN transistors 175, 176 and 177 not conducting. As transistor 176 goes not conductive, the current supplied by current source 180 is no longer diverted through transistor 176 to point of reference or ground potential 2, consequently, the current supplied by current source 180 again flows through diode 182 and resistor 161 and is sinked to point of reference or ground potential 2 through current sink 162. Therefore, the circuitry including current source 180 and diode 182 that is effective when activated in response to the data processor unit operating mode select output signal of a first potential level to increase the reference potential signal to a second potential level that is of a second selected substantially constant incremental potential value greater than the first potential level at all engine speeds is reactivated when the potential upon terminal end 22*a* of output coil 22 of electrical generator assembly 20 has attained a level substantially equal to that of the reference potential signal of the first potential level whereby the potential level of the reference potential signal upon junction 165 increases to the second potential level value. As transistor 177 goes not conductive, current source 183 supplies base-emitter drive current for NPN transistor 184 to render this device conductive. Upon the conduction of transistor 184, the signal upon junction 185, the output signal of the circuitry of FIG. 3, goes to substantially ground potential and is, therefore, a logic 0 output signal. As NPN transistor 184 is rendered conductive during each positive polarity half cycle of the alternating current timing signals when the level of the potential upon terminal end 22*a* of output coil 22 of electrical generator assembly 20 reduces in a negative going direction to a potential level value substantially equal to that of the potential signal present upon terminal end 22*b* plus the incremental potential level value produced by the flow of current from current source 163 through resistor 161, this logic 0 output signal is produced substantially at the time the potential level upon terminal end 22*a* of output coil 22 crosses that of the potential upon terminal end 22*b*. This logic 0 signal is the engine crankshaft position reference signal that is applied through resistor 190, lead 191, circuit points 191(3) and 191(1) of respective FIGS. 3 and 1 and the FIG. 1 extension of lead 191 to electronic data processor unit 15. As this logic 0 engine crankshaft position reference output signal is produced at each positive to negative polarity transition of the potential level of the alternating current timing signals upon terminal end 22*a* of output coil 22, an output crankshaft position reference signal is produced for each cylinder of engine 3. To produce this signal at a preselected constant engine crankshaft angle relative to piston top dead center, the ignition distributor is adjusted to the point at which this positive to negative polarity transition occurs substantially at this predetermined constant engine crankshaft angle.

As previously explained in this specification, with a logic 1 operating mode select output signal upon output terminal 59 of electronic data processor unit 15, NPN transistor 67 of the operating mode select switching circuitry contained within dashed line rectangle 24 of FIG. 1 is not conductive. With transistor 67 not conductive, base-emitter drive current is supplied to NPN transistors 168 and 169 of FIG. 3 through a circuit that may be traced from current source 68 of FIG. 1, through lead 157, circuit points 157(1) and 157(3) of respective FIGS. 1 and 3, the FIG. 3 extension of lead 157 and respective resistors 166 and 167. This base-emitter drive current renders both NPN transistors 168 and 169 conductive. Conducting transistor 169 diverts the current supplied by current source 180 to point of reference or ground potential 2 to deactivate the circuitry consisting of current source 180 and diode 182 and conducting transistor 168 diverts the current supplied by current source 170 to point of reference or ground potential 2. Upon the conduction of transistor 168, therefore, base drive current is diverted from transistor 171 to render this device not conductive. Assuming that the potential signal upon terminal end 22*a* of output coil 22 of electrical generator assembly 20 is of a negative polarity with respect to the potential signal upon terminal end 22*b*, NPN transistor 160 is not conductive. With transistor 160 not conducting, there is no circuit through which emitter-base drive current may be supplied to dual collector PNP transistor 174, consequently, this device is also not conductive. While transistor 174 is not conductive, there is no base-emitter drive current supplied to NPN transistors 175, 176 and 177, consequently, these device are also not conductive. With transistor 171 and transistor 175 are conductive, the current supplied by current source 172 flows through lead 192, diode 173 and resistor 161 and is sinked to point of reference or ground potential 2 through current sink 162. As current source 172 is arranged to supply more current than current source 180, as a result of this current flow through resistor 161 in addition to the current supplied by current source 163 flowing through resistor 161, the reference potential signal upon junction 165 is increased to a third potential level with respect to point of reference or ground potential 2 that is of a third selected substantially constant incremental potential value greater than the first potential level of this reference signal by an amount equal to the potential drop across resistor 161 as a result of the additional current supplied by current source 172 flowing therethrough. This third selected substantially constant incremental potential value is added to the potential level appearing upon terminal end 22*b* of output coil 22 of the electrical generator assembly 20 at all engine speeds. As previously explained, as transistor 168 is conductive and transistor 171 is not conductive during the presence of a logic 1 operating mode select output signal upon output terminal 59 of electronic data processor unit 15, the circuitry including current source 172 and diode 173 is activated in response to a logic 1 data processor unit 15 operating mode select output signal. Consequently, the circuitry including current source 172 and diode 173 is effective when activated in response to a logic 1 data processor unit operating mode select output signal to increase the reference potential signal upon junction 165 to a third potential level that is of a third selected substantially constant incremental potential value greater than that of the first potential level at all engine speeds. This higher reference potential signal level increases the noise immunity of the system. The reference potential signal of the third potential level upon junction 165 supplies base-emitter drive current to NPN transistor 179 to render this device conductive through the collector-emitter electrodes thereof and is the potential level with respect to point of reference or ground potential 2 to which the potential level with respect to point of reference or ground potential 2 upon terminal end 22*a* of output coil 22 of electrical generator assembly 20 must rise to render NPN transistor 160 conductive. The non-conduction of NPN transistor 176 is of no consequence at this time as NPN transistor 169 with which it is connected in parallel is conductive. With NPN transistor 177 not conducting, current source 183 supplies base-emitter drive current to NPN transistor 184 to render this device conductive through the collector-emitter electrodes thereof. With transistor 184 conducting, the potential upon junction 185, the output signal of the circuitry of FIG. 3, is substantially ground potential or a logic 0. As the potential level with respect to point of reference or ground potential 2 upon terminal end 22*a* of output coil 22 of electrical generator assembly 20 increases in a positive going direction to a potential level substantially equal to that of the reference potential signal of the third potential level present upon junction 165, transistor 160 is rendered conductive. When transistor 160 conducts, transistor 179 goes not conductive and transistor 174 emitter-collector current begins to flow through conducting transistor 160 and current sink 186 to point of reference or ground potential 2. The collector current of transistor 174 supplies base-emitter drive current through resistors 187, 188 and 189 to respective NPN transistors 175, 176 and 177 to render these devices conductive. As transistor 176 is connected in parallel with an already conducting transistor 169, this transistor is of no consequence at this time. Conducting transistor 175, however, diverts the current supplied by current source 172 to point of reference or ground potential 2 and conducting transistor 177 diverts the current supplied by current source 183 to point of reference or ground potential 2. As conducting transistor 177 diverts the current supplied by current source 183 to point of reference or ground potential 2, insufficient base-emitter drive current is supplied to NPN transistor 184 to maintain this device conductive, consequently, transistor 184 goes not conductive. When transistor 184 goes not conductive, the signal upon junction 185, the output signal of the circuitry of FIG. 3, is of a potential level substantially equal to Zener diode 197 potential and is therefore a logic 1 output signal. As conducting transistor 175 diverts the current supplied by current source 172 to point of reference or ground potential 2, the current supplied by current source 172 no longer flows through resistor 161 and current sink 162. Consequently, when the potential level upon terminal end 22*a* of output coil 22 of electrical generator assembly 20 attains a level substantially equal to that of the reference potential signal of the third potential level upon junction 165, the circuitry including current source 172 and diode 173 that is effective to increase the reference potential signal upon junction 165 to the third potential level is deactivated and the reference potential signal upon junction 165 is reduced to the first potential level that is of a value substantially equal to the potential level upon terminal end 22*b* of output coil 22 of electrical generator assembly 20 plus the potential drop across resistor 161 as a result of the current supplied by current source 163 flowing therethrough. This lower reference potential signal of the first potential level upon junction 165 sets the turn-off point for transistor 160. As the potential level upon terminal end 22*a* of output coil 22 of electrical generator assembly 20 continues through the positive polarity half of each cycle of the alternating current timing signals induced therein, this potential level goes through maximum and falls in a negative going direction until it is of a level substantially equal to that of the reference potential signal of the first potential level present upon junction 165. At this time, NPN transistor 160 is rendered not conductive and NPN transistor 179 is rendered conductive. Upon transistor 160 going not conductive, emitter-collector current flow ceases through transistor 174 to place the circuitry in the initial state with NPN transistors 175, 176 and 177 not conducting. As transistor 175 goes not conductive, the current supplied by current source 172 is no longer diverted through transistor 175 to point of reference or ground potential 2, consequently, the current supplied by current source 172 again flows through diode 173 and resistor 161 and is sinked to point of reference or ground potential 2 through current sink 162. Therefore, the circuitry including current source 172 and diode 173 that is effective when activated in response to the data processor unit operating mode select output signal of a second potential level to increase the reference potential signal to a third potential level that is of a third selected substantially constant incremental potential value greater than the first potential level at all engine speeds is reactivated when the potential upon terminal end 22*a* of output coil 22 electrical generator assembly 20 has attained a level substantially equal to that of the reference potential signal of the first potential level whereby the potential level of the reference potential signal upon junction 165 increases to the third potential level value. As transistor 177 goes not conductive, current source 183 supplies base-emitter drive current for NPN transistor 184 to render this device conductive. Upon the conduction of transistor 184, the signal upon junction 185, the output signal of the circuitry of FIG. 3, goes to substantially ground potential and is, therefore, a logic 0 output signal. As NPN transistor 184 is rendered conductive during each positive polarity half cycle of the alternating current timing signals when the level of the potential upon terminal end 22*a* of output coil 22 of electrical generator assembly 20 reduces in a negative going direction to a potential level value substantially equal to that of the potential signal present upon terminal end **22*b* plus the incremental potential level value produced by the flow of current from current source 163 through resistor 161, this logic 0 output signal is produced substantially at the time the potential level upon terminal end 22*a* of output coil 22 crosses that of the potential upon terminal end 22*b*. As has been hereinbefore brought out, this logic 0 signal is the engine crankshaft position reference signal that is applied through resistor 190, lead 191, circuit points 191(3) and 191(1) of respective FIGS. 3 and 1 and the FIG. 1 extension of lead 191 to electronic data processor unit 15**.

Resistor 38 of FIG. 1 provides a voltage to forward bias diode 36 and resistor 39 is a current limiting resistor. Resistor 193 of FIG. 3 is a current limiting resistor and resistors 194, 195 and 196 are base bias circuit resistors. Zener diode 197 provides transient protection for NPN transistor 184.

While a preferred embodiment of the present invention has been shown and described, it will be obvious to those skilled in the art that various modifications and substitutions may be made without departing from the spirit of the invention that is to be limited only within the scope of the appended claims.

The embodiments of the invention for which an exclusive property or privilege is claimed are defined as follows:

1. In combination with an electrical generator assembly of the type having at least a rotatable rotor member and an output coil in which a series of alternating current signals is magnetically induced while the rotor member is rotated, a circuit for producing an output signal upon a selected polarity transition of each cycle of the series of alternating current signals comprising:

means for producing a reference potential signal of a first potential level that is of a first selected incremental potential value greater than the potential level upon a selected first terminal end of said electrical generator assembly output coil;

first circuit means effective when activated to increase said reference potential signal to a second potential level that is of a second selected incremental potential value greater than said first potential level; and means responsive to said reference potential signal and the potential level upon the other second terminal end of said electrical generator assembly output coil for deactivating said first circuit means when the potential upon said other second terminal end of said electrical generator assembly output coil has attained a level substantially equal to that of said reference potential signal resulting from the activated said first circuit means whereby the potential level of said reference potential signal is reduced to said first potential level and for reactivating said first circuit means whereby the potential of said reference potential signal is increased to the potential level resulting from the activated said first circuit means and for producing an output signal when the potential upon said other second terminal end of said electrical generator assembly output coil has attained a level substantially equal to that of said reference potential signal of said first potential level whereby an output signal is produced upon a selected polarity transition of each cycle of said alternating current signals produced by said electrical generator assembly.

* * * * *